US007699143B2

(12) United States Patent
Tschuemperlin et al.

(10) Patent No.: US 7,699,143 B2
(45) Date of Patent: Apr. 20, 2010

(54) METHOD OF SETTING THE FLOOR ASSOCIATIONS OF A PLURALITY OF OPERATING UNITS OF AN ELEVATOR INSTALLATION

(75) Inventors: Erich Tschuemperlin, Kriens (CH); Philippe Henneau, Zurich (CH); Peter Baertschi, Zug (CH)

(73) Assignee: Inventio AG, Hergiswil NW (CH)

( * ) Notice: Subject to any disclaimer, the term of this patent is extended or adjusted under 35 U.S.C. 154(b) by 465 days.

(21) Appl. No.: 11/738,022

(22) Filed: Apr. 20, 2007

(65) Prior Publication Data

US 2007/0246306 A1 Oct. 25, 2007

(30) Foreign Application Priority Data

Apr. 20, 2006 (EP) ..... 06112859

(51) Int. Cl.
*B66B 3/02* (2006.01)

(52) U.S. Cl. ..... 187/394

(58) Field of Classification Search ..... 187/247, 187/248, 391–394, 413, 414
See application file for complete search history.

(56) References Cited

U.S. PATENT DOCUMENTS 4,166,518 A 9/1979 Nakazato et al.
4,233,588 A * 11/1980 Satoh ..... 187/394
5,783,784 A * 7/1998 Durand ..... 187/394
6,427,807 B1 8/2002 Henneau
6,672,429 B1 1/2004 Thurmond, III
7,077,244 B2 * 7/2006 Oh et al. ..... 187/394
7,441,631 B2 * 10/2008 Oh et al. ..... 187/394

FOREIGN PATENT DOCUMENTS

EP 0100866 A1 2/1984
EP 0248997 A1 12/1987
FR 2398687 A1 2/1979
GB 1468061 A 3/1977

* cited by examiner

*Primary Examiner*—Jonathan Salata
(74) *Attorney, Agent, or Firm*—Fraser Clemens Martin & Miller LLC; William J. Clemens

(57) ABSTRACT

In a method for setting the floor associations of a plurality of operating units of an elevator installation, a plurality of operating units is distributed over a plurality of floors. These floors can be traveled to by an elevator car having a transmitter unit. In the method, the elevator car is moved to a predetermined one of the floors. The operating unit allocated to the moved-to floor is activated. The position data describing the floor at which the operating unit is located are communicated from the transmitter unit to the operating unit and/or to a central control unit. The position data are stored in a memory unit of the operating unit and/or in the central control unit.

12 Claims, 1 Drawing Sheet

METHOD OF SETTING THE FLOOR ASSOCIATIONS OF A PLURALITY OF OPERATING UNITS OF AN ELEVATOR INSTALLATION

FIELD OF THE INVENTION

The present invention relates to a method of setting the floor associations of a plurality of operating units of an elevator installation, wherein the operating units are distributed over a plurality of floors and the floors can be traveled to by an elevator car, which has a transmitter unit.

BACKGROUND OF THE INVENTION

Within the scope of mounting and installing an elevator installation in a building the elevator car is moved during a so-termed learning travel to all stopping positions, i.e. to all floors, in order to set the stopping positions to the height levels of the respective floors. In addition, the operating units, for example panels equipped with destination call buttons, distributed over the individual floors and the communication thereof with the central control unit have to be set or configured. In this connection it is necessary to define these operating panels, which are provided in the elevator installation access region of each floor, with respect to their position, i.e. the floor, and to associate the operating unit therewith.

This setting is conventionally carried out by means of several switches which have to be manually set in each instance by an engineer at every floor and at every operating unit. Configurations manually carried out in this manner require a high outlay in terms of time and personnel. Beyond that, such switches represent costly components.

The operating unit normally consists of a printed circuit comprising a panel for the call input and an indicator. The panel for the call input and the indicator are in part two different printed circuits. In this case the operating unit consists of two printed circuits which both have to be set.

SUMMARY OF THE INVENTION

The present invention therefore has an object of so developing a method for setting the floor associations of a plurality of operating units of an elevator installation that the floor associations of the operating units can be set more simply.

According to the present invention for fulfillment of this object in the case of a method of setting the floor associations of a plurality of operating units of an elevator installation, wherein the operating units are distributed over a plurality of floors and the floors can be traveled to by an elevator car having a sensor unit, there is provided a method comprising the following steps:

a) moving the elevator car to a predetermined floor;

b) activating the operating unit allocated to the moved-to floor;

c) communicating position data, which describe the floor in which the operating unit is located, from the transmitter unit to the operating unit or to the central control unit; and d) storing the position data in a memory unit of the operating unit or in the central control unit.

A comparatively simple and rapidly performed setting of the floor associations of the operating unit is possible by the method according to the present invention. Thus, it is possible to dispense with manual setting of switches of each individual operating unit. In addition, possible erroneous settings of the switches are thereby reduced.

By an "operating unit" in the sense of the present invention there are understood the panels, which are provided in the access region of each floor to the elevator installation, with at least one switch, which is operable by the user, for utilization of the elevator installation. Preferably there is concerned in that case the usual destination call direction buttons.

In an advantageous development of the present invention it is provided that the elevator car is moved to the floor by means of automatic control by way of the central control unit. Thus, a setting program can be provided which enables travel to all floors for the purpose of association of the individual operating units. Alternatively, the floors can also be traveled to by manual actuation of corresponding destination call switches of the elevator car.

In a development of the method according to the present invention it is proposed that the operating unit is activated by transmission of an activation signal from the transmitter unit to the operating unit. Alternatively, however, this activation process can also be carried out manually by actuation of the operating unit.

Advantageously the position data are additionally stored in the central control unit. Moreover, it can be provided that, in addition to the position data, there is also transmission of data characterizing the access to the elevator car. This applies to elevator installations in which the elevator car has more than one car door. Each car door forms such an access.

In order to achieve setting of the floor associations of all operating units for all floors in simple manner the above-mentioned steps a) to d) are repeated for all floors present in the respective building. Equally, the aforesaid steps are repeated in each floor for each access to the elevator car.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
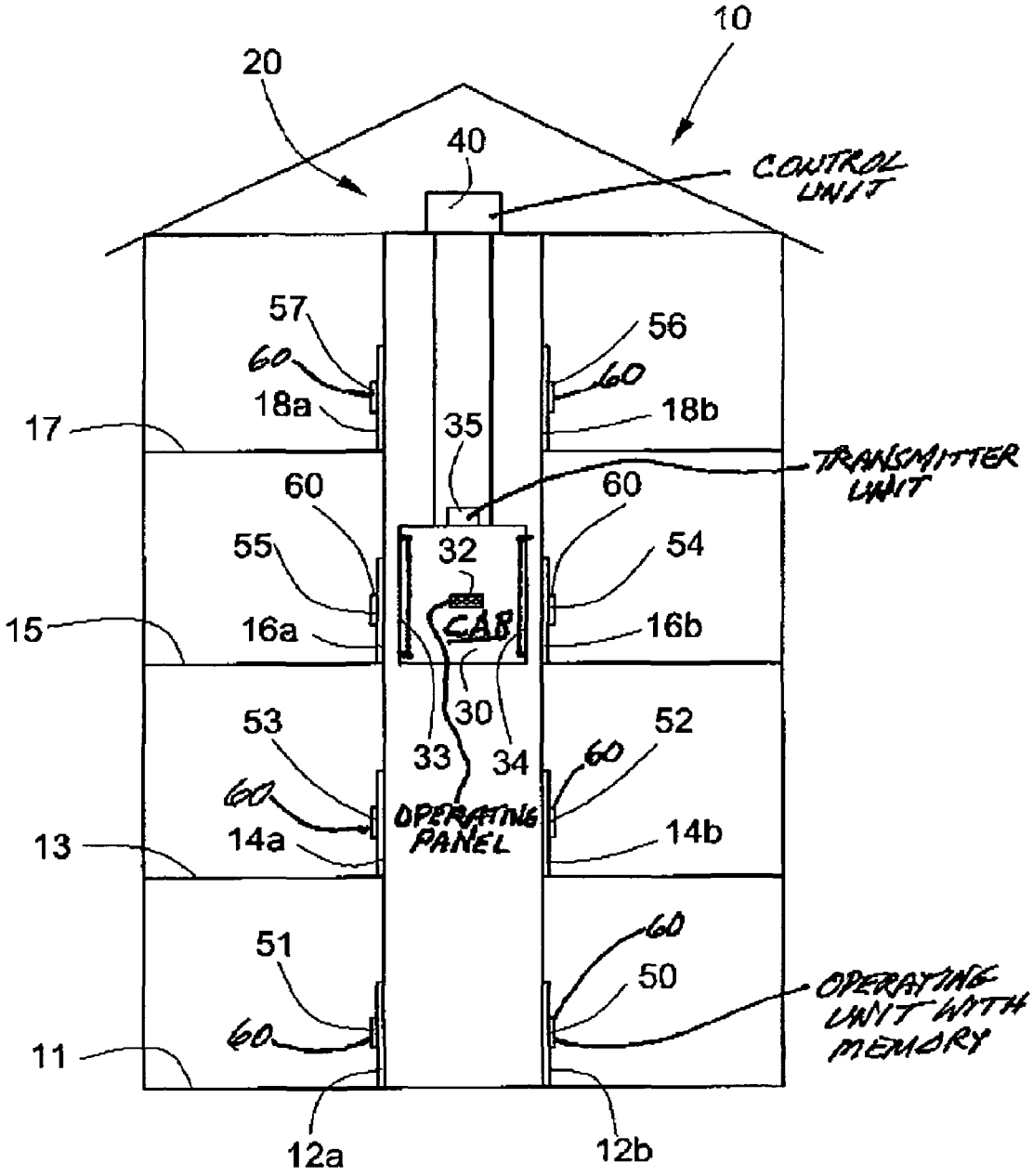
FIG. 1 is a schematic diagram of a building with an elevator installation for performing the method according to the present invention.

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

FIG. 1 schematically shows a building 10 with an elevator installation 20. The elevator installation 20 comprises a vertically movable elevator car 30 with two car doors 33, 34 and an operating panel 32 with several destination call switches. A transmitter unit 35 disposed in data exchange communication with a central control unit 40 is provided at the elevator car 30. The central control unit 40 serves for controlling the elevator installation 20.

The building 10 comprises a first floor 11, a second floor 13, a third floor 15 and a fourth floor 17. A respective left-hand side access and a right-hand side access, which are each closable by means of an access door 12*a*, 12*b*, 14*a*, 14*b*, 16*a*, 16*b*, 18*a*, 18*b*, to the elevator installation 20 are disposed on each of these floors 11, 13, 15 and 17. The elevator car 30 can be entered and left from two sides by way of these accesses. Disposed in the region of each access is an operating unit 50 to 57 by way of which a user can summon the elevator car 30 and/or input a destination call. Each operating unit 50 to 57 comprises a memory unit 60 and several destination call buttons. In addition, each operating unit 50 to 57 is disposed in data communication with the central control unit 40.

On the basis of this system two variants of a method of setting the floor associations of the operating units 50 to 57 are explained in the following.

In a first variant of the method according to the present invention the central control unit 40 is initially placed in a setting mode. First of all, the elevator car 30 is moved to the fourth floor 17 and the car door 34 opened. A member of the engineering personnel enters the elevator car 30 and actuates one of the destination call buttons of the operating panel 32 so that the elevator car 30 is moved to the third floor 15. After the elevator car 30 has reached the third floor 15, the car door 34 and the access door 16*b* opened. The person leaves the elevator car 30 and actuates a button of the operating unit 54 so as to activate this. After producing a data radio connection between the transmitter unit 35 and the operating unit 54 the transmitter unit 35 communicates position data to the operating unit 54 and/or to the central control unit 40. The position data are filed in the transmitter unit 35 and/or the central control unit 40 or ascertained by the units 35, 40. The position data communicated to the operating unit 54 contain details of the floor number of the building 10 and the designation of the access or the access door 16*b*. The position data are preferably stored in the memory unit 60 of the operating unit 54. In this manner in later operation of the elevator installation 20 the central control unit 40 is able to recognize, on issue of a destination call by way of the operating unit 54, at which floor and in the region of which access the person to be conveyed is located.

Subsequently, the person enters the elevator car 30 and actuates a corresponding button of the operating panel 32 for closing the car door 34. The person thereafter actuates a further button of the operating panel 32 so as to open the left-hand side car door 33 and the access door 16*a*. After leaving the elevator car 30 in the left-hand side region of the floor 15 the person actuates the operating unit 54 so as to activate this. After producing a data connection between the transmitter unit 35 and the operating unit 55 the transmitter unit 35 communicates, in correspondence with the above procedure, the position data to the operating unit 55. The position data are filed in the memory unit 60 of the operating unit 55 and/or in the central control unit 40.

After re-entering the elevator car 30 the person actuates the operating panel 32 so as to move the elevator car 30 to the second floor 13. The above-described method steps are correspondingly carried out at this floor 13 as well all remaining floors concerned so that at the end of the setting method each operating unit 50 to 57 is assigned to the respective floor 11, 13, 15, 17. Thus the central unit 40 in the case of later, normal operation of the elevator installation 20 can unambiguously recognize from which operating unit 50 to 57 a corresponding destination call has been issued.

The second variant of the method according to the present invention differs from the first variant essentially in that the setting method is carried out largely automatically. In this manner it is not required for a member of the engineering personnel to actuate the individual operating units 50 to 57 and the operating panel 32 of the elevator car 30 during the "setting travel" in order to make possible communication of the position data and travel of the elevator car 30 between the individual floors 11, 13, 15, 17.

In this second variant the transmitter unit 35 comprises an RFID transmitter part, which transmits an activation signal over a predetermined time period within a predetermined range. In the present case the range is approximately one to two meters. In addition, all operating units 50 to 57 comprise a respective RFID receiver part.

The RFID chip can be a printed circuit on the indicator/operating unit, since an RFID chip costs only a couple of cents and the receiver unit is significantly more expensive. The transmitted ID of the RFID chip has to agree with the printed circuit address. This allows, after detection of the RFID chip, the indicator/operating unit to selectively respond by way of the field bus and to be configured.

The rather more expensive transmitter is mounted on the car and can, if need be, be removed again after the learning travel.

Thus, in a first step the elevator car 30 starting from the uppermost floor 17 is automatically moved to the third floor 15 and the corresponding car door 34 and access door 16*b* automatically opened. As soon as the transmitter unit 35 is located within the predetermined range of the operating unit 54 the operating unit 54 receives the activation signal transmitted by the RFID transmitter part, whereby the operating unit 54 is activated. The operating unit 54 subsequently transmits a confirmation signal to the transmitter unit 35. In the next step the transmitter unit 35 communicates, as in the case of the first variant, the position data to the operating unit 54 and/or to the central control unit 40. The position data are in turn filed in the memory unit 60 of the operating unit 54 and/or in the central control unit 40. The access door 16*b* and car door 34 are subsequently automatically closed and the access door 16*a* and car door 33 oriented towards the other side of the floor 15 automatically opened. The activation signal transmitted by the RFID transmitting part of the transmitter unit 35 is received by the RFID receiving part of the operating unit 55. Thereafter communication of the confirmation signal to the transmitter unit 35 and the position data to the operating unit 55 and/or to the central control unit 40 takes place again. The position data are filed in the memory unit 60 of the operating unit 55 and/or in the central control unit 40. The access door 16*a* and car door 33 are subsequently automatically closed and the elevator car 30 moved to the floor 13.

Thereafter, all afore-described method steps are repeated at all floors 11, 13, 15, 17 for the right-hand side and the left-hand access. In this manner all operating units 50 to 57 of all floors 11, 13, 15, 17 can be provided, by means of a fully automatic setting method, with the appropriate data for setting the floor associations.

The two afore-described variants of the method according to the present invention are particularly distinguished by the fact that for setting the floor associations of the operating units 50 to 57 it is not necessary to undertake any manual actuation of conventionally present switches of the operating units 50 to 57. This setting can be performed by the method according to the present invention with a preferably wire-free data transmission by means of RFID technology. In that case the second embodiment of the method is distinguished particularly by the fact that the RFID receiver parts are mounted at the operating units 50 to 57 only temporarily and can be removed after performance of the setting method and utilized for, for example, configuration of a further elevator installation in another building.

In a given case the installer must, after the learning travel, undertake manual actions again in order to remove the transmitters from the indicators/operating units.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of setting floor associations of a plurality of operating units of an elevator installation, wherein the operating units are distributed over a plurality of floors and the floors can be traveled to by an elevator car, wherein the elevator car has a transmitter unit and wherein the method comprises the steps of:

a. operating the elevator car to travel to a predetermined one of the floors;

b. activating the operating unit allocated to the traveled-to one floor;

c. communicating position data, which describe the traveled-to one floor at which the operating unit is located, from the transmitter unit to the operating unit and/or to a central control unit of the elevator installation; and d. storing the position data in a memory unit of the operating unit or in the central control unit.

2. The method according to claim 1 including performing said step a. by moving the elevator car to the one floor utilizing automatic control by the central control unit.

3. The method according to claim 1 including performing said step b. by activating the operating unit by transmission of an activation signal from the transmitter unit to the operating unit.

4. The method according to claim 1 including performing said step d. by storing the position data in the memory unit of the operating unit and in the central control unit.

5. The method according to claim 1 including transmitting data which designates an access to the elevator car from the one floor.

6. The method according to claim 1 including repeating said steps a. through d. for all of the floors traveled to by the elevator.

7. The method according to claim 1 including repeating said steps a. through d. for each of the floors for designating each access to the elevator car at the floors.

8. A method of setting floor associations of a plurality of operating units of an elevator installation, wherein the operating units are distributed over a plurality of floors and the floors can be traveled to by an elevator car, wherein the elevator car has a transmitter unit and wherein the method comprises the steps of:

a. operating the elevator car to travel to a predetermined one of the floors;

b. activating the operating unit allocated to the traveled-to one floor;

c. communicating position data, which describe the traveled-to one floor at which the operating unit is located, from the transmitter unit to the operating unit and/or to a central control unit of the elevator installation, the position data including an associated floor number and a designation of each access to the elevator car from the traveled-to one floor; and d. storing the position data in a memory unit of the operating unit or in the central control unit.

9. The method according to claim 8 including performing said step a. by moving the elevator car to the one floor utilizing automatic control by the central control unit.

10. The method according to claim 8 including performing said step b. by activating the operating unit by transmission of an activation signal from the transmitter unit to the operating unit.

11. The method according to claim 8 including performing said step d. by storing the position data in the memory unit of the operating unit and in the central control unit.

12. The method according to claim 8 including repeating said steps a. through d. for all of the floors traveled to by the elevator.

* * * * *